US006088832A

United States Patent [19]

Newman

[11] Patent Number: 6,088,832

[45] Date of Patent: Jul. 18, 2000

[54] WATERTIGHT SWIMWEAR CONSTRUCTION

[76] Inventor: Marlene Newman, 12 Tuckahoe Rd., Jefferson Farms, New Castle, Del. 19720

[21] Appl. No.: 09/245,646

[22] Filed: Feb. 8, 1999

[51] Int. Cl.[7] ..... A41D 5/00

[52] U.S. Cl. ..... 2/67; 2/238; 2/68

[58] Field of Search ..... 2/67, 68, DIG. 5, 2/215, 228, 238; 450/106

[56] References Cited

U.S. PATENT DOCUMENTS

| | | | |
|---|---|---|---|
| 1,771,178 | 7/1930 | Howland | 2/68 |
| 1,781,842 | 11/1930 | Howland | 2/68 |
| 1,911,227 | 5/1933 | Galligan | 2/67 |
| 3,852,823 | 12/1974 | Jones | 2/68 |
| 3,996,621 | 12/1976 | Martienssen | 2/68 |
| 4,281,417 | 8/1981 | Valentine | 2/68 |
| 4,365,351 | 12/1982 | Doershuck et al. | 2/351 |
| 4,400,830 | 8/1983 | Gaitan | 2/68 |
| 4,999,845 | 3/1991 | Jenks et al. | 2/2.1 R |
| 5,349,702 | 9/1994 | Runckel | 2/68 |

*Primary Examiner*—Bibhu Mohanty
*Attorney, Agent, or Firm*—Henderson & Sturm LLP

[57] ABSTRACT

A watertight swimwear construction 10 for an article of swimwear 20 such as a bathing cap 21, a pair of men's swim trunks 22 and a woman's one-piece bathing suit 23 having at least one opening 24, 25, 26, or 27 which surrounds a portion of a swimmer. The periphery of the opening 24, 25, 26, or 27 is provided with an elongated strip of resilient material 31 having a plurality of suction cups 37 disposed in a side-by-side fashion on the front face 32 to prevent water, sand, etc., from passing through said opening.

6 Claims, 1 Drawing Sheet

WATERTIGHT SWIMWEAR CONSTRUCTION

BACKGROUND OF THE INVENTION

1. Field of the Invention

The present invention relates to the field of waterproofing arrangements in general, and in particular to a watertight construction for swimwear.

2. Description of Related Art

As can be seen by reference to the following U.S. Pat. Nos. 3,852,823; 3,996,621; 4,281,417; 4,400,830; and 5,349,702, the prior art is replete with myriad and diverse approaches for making shower caps and swimming caps watertight.

While all of the aforementioned prior art constructions are more than adequate for the basic purpose and function for which they have been specifically designed, they are uniformly deficient with respect to their failure to provide a simple, efficient, and practical arrangement that can make both men's and women's swimwear, as well as swimming caps watertight.

As anyone who as swam in the ocean is all too well aware, as enjoyable as this pastime is, it is not without drawbacks, such as the uncanny ability of a multitude of particles of sand to collect around the crotch area of the swimwear.

As a consequence of the foregoing situation, there has existed a longstanding need for a new and improved type of watertight swimwear construction that will not only keep sand out of the user's swimwear, but will also in the case of incontinent individuals, restrict any waste products to the confines of the bathing suit, and the provision of such a construction is a stated objective of the present invention.

BRIEF SUMMARY OF THE INVENTION

Briefly stated, the watertight swimwear construction that forms the basis of the present invention comprises in general, a suction cup sealing strips that is secured to the interior of the leg holes in both men's and women's swimwear and the waist portion of a woman's one-piece bathing suit, as well as the interior periphery of a bathing cap.

As will be explained in greater detail further on in the specification, the suction cup sealing strip of the preferred embodiment comprises in general, an adhesive backed strip of generally resilient material having a diamond shaped waffle iron pattern of suction cups formed on the face of the sealing strip. The suction cups are held in sealing engagement with the user's torso surfaces not only by the force of suction and the elastic nature of the resilient strip of material, but also by the water pressure that is being exerted against the exterior of the swimwear which is submerged as the user swims, wades, floats, or dives.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
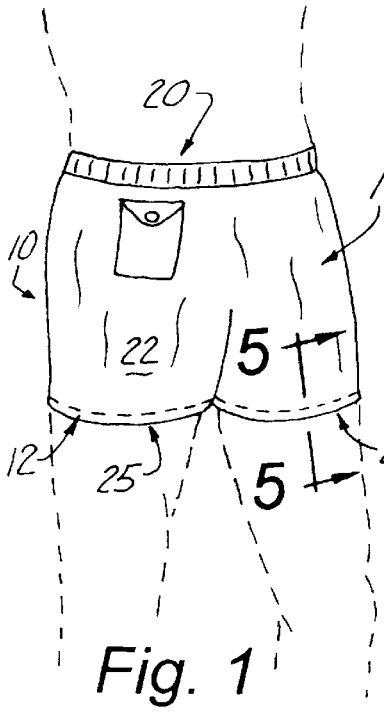
FIG. 1 shows a man wearing a bathing suit provided with a pair of suction cups sealing strips.

As can be seen by reference to the drawings, and in particular to FIG. 1, the watertight swimwear construction that forms the basis of the present invention is designated generally by the reference number 10. The swimwear construction 10 comprises in general, a swimwear unit 11 and a sealing unit 12. These units will now be described in seriatim fashion.

Figure 2:
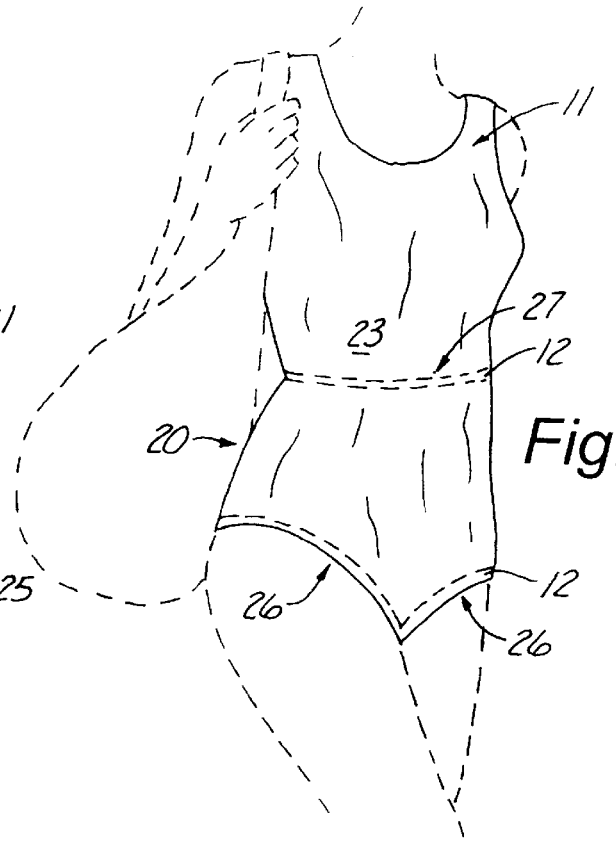
FIG. 2 shows a woman wearing a one piece bathing suit provided with a pair of leg hole sealing strips and a waist encircling sealing strip.
Figure 3:
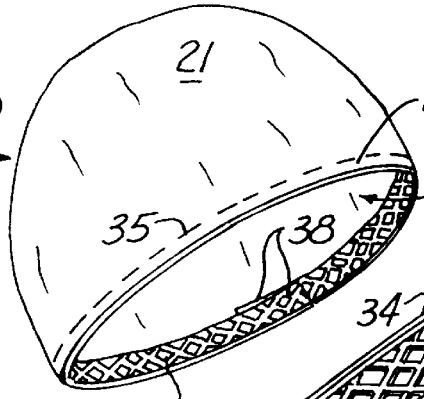
FIG. 3 shows a bathing cap provided with the suction cups sealing strip.

As shown in FIGS. 1 through 3, the swimwear unit 11 comprises an article of swimwear 20 such as a bathing cap 21, a pair of men's swim trunks 22, or a woman's one piece bathing suit 23. The article of swimwear 20 is provided with at least one body encircling opening such as the single enlarged opening 24 in the bathing cap 21, the pair of leg openings 25, 25, and 26, 26 in the men's 22 and woman's 23 bathing suits, respectively, as well as the waist opening 27 in a woman's one piece bathing suit.

Figure 4:
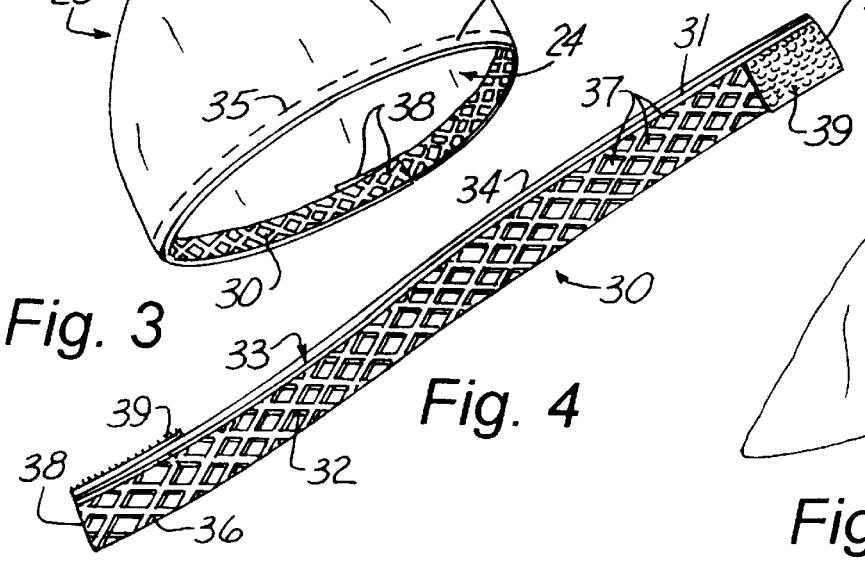
FIG. 4 is a perspective view of the suction cup sealing strip of this invention.
Figure 5:
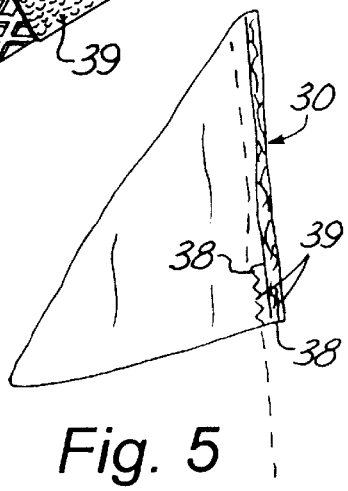
FIG. 5 is a detailed view of the engagement of the opposite ends of the suction cup sealing strip.

As shown in FIGS. 3 through 5, the sealing unit 12 comprises in general, a suction cup sealing strip 30 fabricated from an elongated strip of resilient material 31 having a front face 32 and a back face 33. The back face 33 is adapted to be secured to an interior periphery of the one or more openings 24, 25, 26 of an article of swimwear 20 such as by adhesives 34 or stitching 35.

In addition, the front face 32 of the resilient strip of material 31 is provided with a raised diamond shaped waffle pattern of intersecting ribs 36. The intersecting ribs 36 form a plurality of suction cup elements 37 arranged in a side-by-side fashion.

By now it should be appreciated that when the suction cup sealing strip 30 is disposed around the periphery of one or more openings 24, 25, or 26, in an article of swimwear 20 and pressed into contact with the swimmer's flesh, water, sand, or waste products are prevented from passing through the opening 24 or openings 25, 25, or 26, 26 and 27 in the articles of swimwear 20.

In the preferred embodiment of the invention illustrated in FIGS. 1 and 2, the opposite ends of the suction cup sealing strip 30 are joined together to form a closed loop that will resiliently expand to accommodate a portion of the swimmer's head or body.

However, in the alternate version of the preferred embodiment illustrated in FIGS. 3 through 5, the opposite ends 38 of the suction cup sealing strip 30 are provided with cooperating fasteners 39. The ends 38 of the strip 30 are stretched and overlapped to engage the fasteners 39 in a firm watertight fashion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A watertight swimwear construction comprising:

a swim wear unit including an article of swimwear comprising a pair of men's swim trunks having at least one opening that encircles a portion of a swimmer; and a sealing unit operatively associated with said at least one opening and comprising an elongated strip of resilient material having opposite ends, a front face and a back face wherein said back face is secured around the periphery of said at least one opening; and wherein said front face is provided with a plurality of suction cups disposed adjacent to one another.

2. The construction as in claim 1 wherein said plurality of suction cups are arranged in a diamond shaped waffle pattern.

3. The construction as in claim 2 wherein said diamond shaped waffle pattern is formed by a plurality of intersecting raised ribs.

4. A watertight swimwear construction comprising:

a swimwear unit including an article of swimwear comprising a woman's one-piece bathing suit having at least one opening that encircles a portion of a swimmer; and a sealing unit operatively associated with said at least one opening and comprising an elongated strip of resilient material having opposite ends, a front face and a back face wherein said back face is secured around the periphery of said at least one opening; and wherein said front face is provided with a plurality of suction cups disposed adjacent to one another.

5. The construction as in claim 4 wherein said plurality of suction cups are arranged in a diamond shaped waffle pattern.

6. The construction as in claim 5 wherein said diamond shaped waffle pattern is formed by a plurality of intersecting raised ribs.

* * * * *